United States Patent [19]

Poppenheimer

[11] Patent Number: 4,574,337

[45] Date of Patent: Mar. 4, 1986

[54] UNDERWATER LIGHTS

[75] Inventor: Charles B. Poppenheimer, Pasadena, Calif.

[73] Assignee: GTY Industries, Sun Valley, Calif.

[21] Appl. No.: 579,134

[22] Filed: Feb. 10, 1984

[51] Int. Cl.[4] ..... F21V 31/00

[52] U.S. Cl. ..... 362/267; 362/269; 362/294; 362/345

[58] Field of Search ..... 362/241, 245, 267, 269, 362/285, 294, 296, 310, 318, 341, 345, 373

[56] References Cited

U.S. PATENT DOCUMENTS

| | | | |
|---|---|---|---|
| 1,792,398 | 2/1931 | Rothen | 362/267 |
| 1,806,435 | 5/1931 | Werner | 362/267 |
| 2,007,489 | 7/1935 | Westberg | 362/345 |
| 3,192,379 | 6/1965 | De Garmo | 362/267 |
| 4,433,366 | 2/1984 | Wade | 362/267 |
| 4,445,163 | 4/1984 | Ziaylek, Jr. | 362/267 |
| 4,460,944 | 7/1984 | Gordbegli et al. | 362/267 |

*Primary Examiner*—Craig R. Feinberg
*Assistant Examiner*—David A. Okonsky
*Attorney, Agent, or Firm*—Lyon & Lyon

[57] ABSTRACT

An underwater light employing a housing positioned within a niche such that water may flow around the housing. A lamp is positioned within the housing directed toward a lens. The lamp reflector is surrounded by high thermal conductivity metallic wool extending out to the housing which may also be of high thermal conductivity. A potting compound in the rear of the housing encapsulates the electrical connections. A lens assembly in one embodiment is illustrated as being pivotal within the niche housing.

14 Claims, 5 Drawing Figures

UNDERWATER LIGHTS

BACKGROUND OF THE INVENTION

The field of the present invention is lighting devices for underwater use.

Swimming pools, fountains and the like traditionally employ underwater lighting to enhance the attractiveness, utility and/or safety of the pool, particularly at night. Such underwater lighting devices often employ the water itself as a heat sink to remove the heat generated by the lamp. In swimming pool construction, a niche is often provided in the wall of the pool. An underwater light is then positioned within the niche such that the pool water may circulate about the light housing within the niche. This circulation of water provides for the removal of heat.

Because of the requirements for substantial amounts of light in pools and fountains, pool lights have traditionally been relatively large in order to adequately dissipate heat. The lenses on such pool lights have typically been in the range of 80 square inches. As a result, the light has a high heat capacity and a large surface area through which heat can be transferred to the surrounding water. However, such lights are architecturally and aesthetically disadvantageous in many circumstances, particularly where wall space may be at a minimum. The large size also adds expense and requires substantial electrical power.

A further difficulty with conventional underwater lighting is its lack of adjustability. Modern day swimming pools are often artistically designed with arcuate shapes, coves and the like. Lighting which is directed outwardly substantially perpendicular from the pool wall often cannot properly light such complex shapes. Consequently, more lighting than necessary is often required to supply the appropriate level of light to all areas of the pool.

SUMMARY OF THE INVENTION

The present invention pertains to an underwater light having high thermal efficiency. This efficiency allows a reduction in the size of the light, its cost, and the power consumed. To this end, elements for directing heat outwardly are arranged between the reflector and the surrounding housing. The housing remains in contact with the water to finally dissipate heat from the light. Copper wool material in good thermal contact with both the reflector and the housing has been found highly advantageous in directing heat to the light housing surface for transfer to the surrounding water.

In a further aspect of the present invention, the underwater light may incorporate a partial ball and socket arrangement such that the light becomes pivotable relative to a surrounding niche. In this way, the light directed outwardly from the wall of the pool may be directed in other than a perpendicular manner from the pool wall. With this adjustability, complex pool shapes may be lit with facility.

In the assembly of the light, a potting compound may be used to effectively seal the leads of the lamp socket. This potting material and the leads may be located at the rear of the housing to accommodate the wool material between the reflector and the housing wall. The reflector may also extend outwardly to the housing for further heat transfer in yet another feature additive to the present invention.

Through the foregoing, smaller lights, having a lens surface area of approximately 20 square inches, are practical. The size of such lights permits far greater architectural freedom for lighting tight spaces such as underwater steps and the like. Reduced cost and power usages are also realized without loss of pool lighting capacity.

Accordingly, it is an object of the present invention to provide an improved underwater lighting device. Other and further objects and advantages will appear hereinafter.

DETAILED DESCRIPTION OF THE PREFERRED EMBODIMENT

Figure 1:
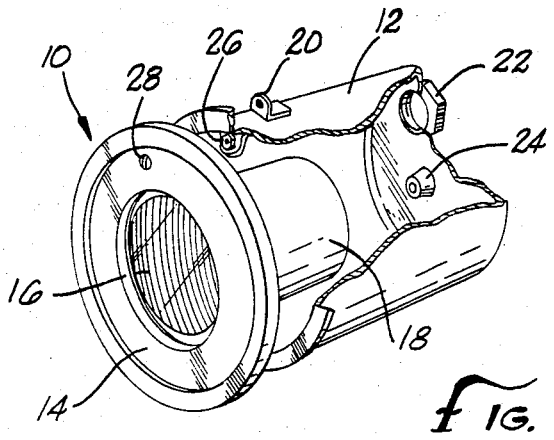
FIG. 1 is an oblique view of a light of the present invention positioned within a niche. The niche housing is partially broken away for clarity.

Turning in detail to the drawings, and particularly FIG. 1, a light, generally designated 10, is illustrated in partial assembly with a niche housing 12. The niche housing 12 is partially broken away for clarity. The light 10 generally includes a face ring 14, a lens 16 and a housing 18. The niche housing 12 includes fixtures 20 for attachment to the wall of the pool, an entry hub 22, a ground lug 24 and a fastening means 26 including a fixed bolt into which a screw 28 associated with the face ring 14 may be threaded.

Figure 2:
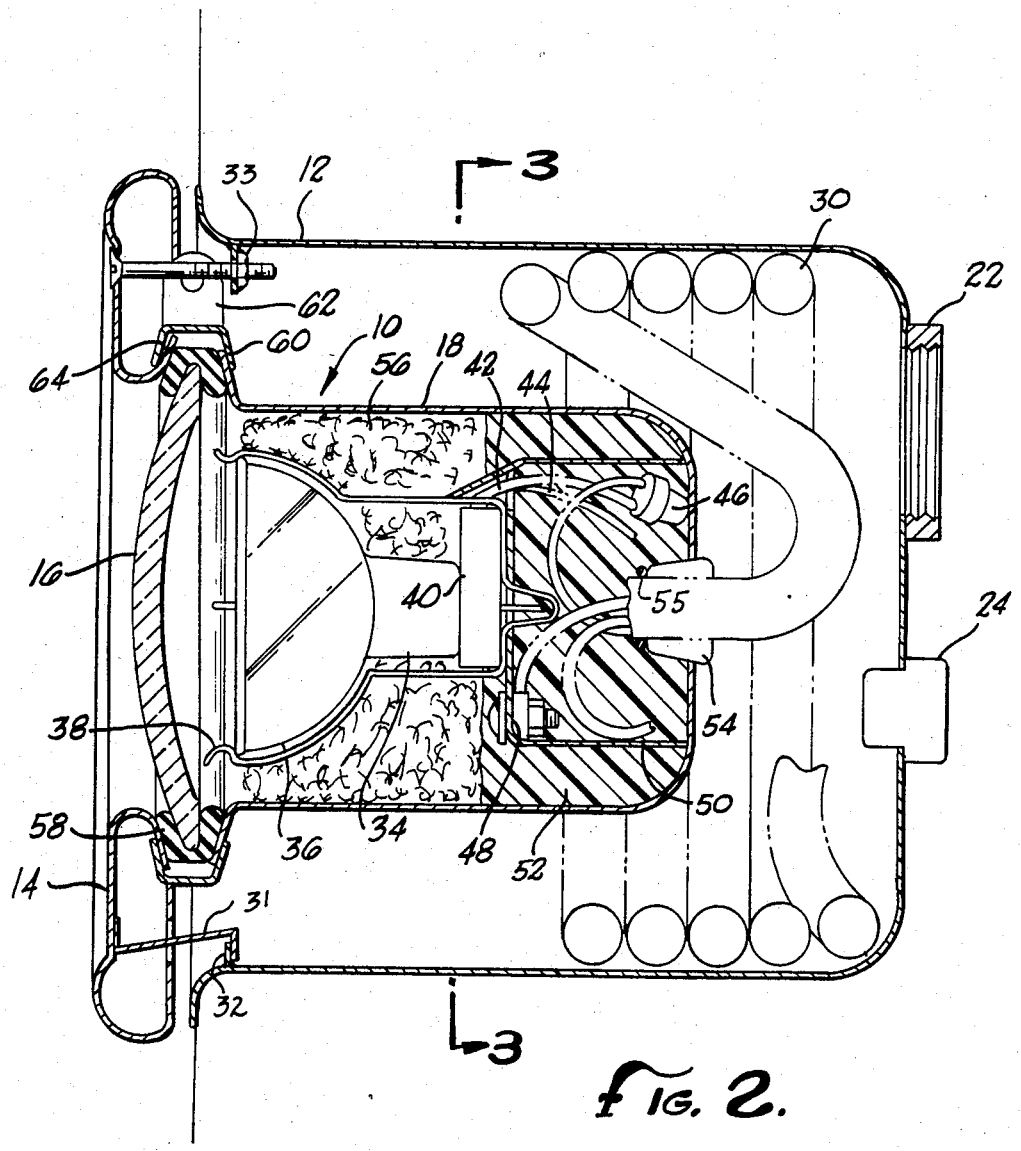
FIG. 2 is a cross-sectional side view of a first embodiment of the present invention.
Figure 3:
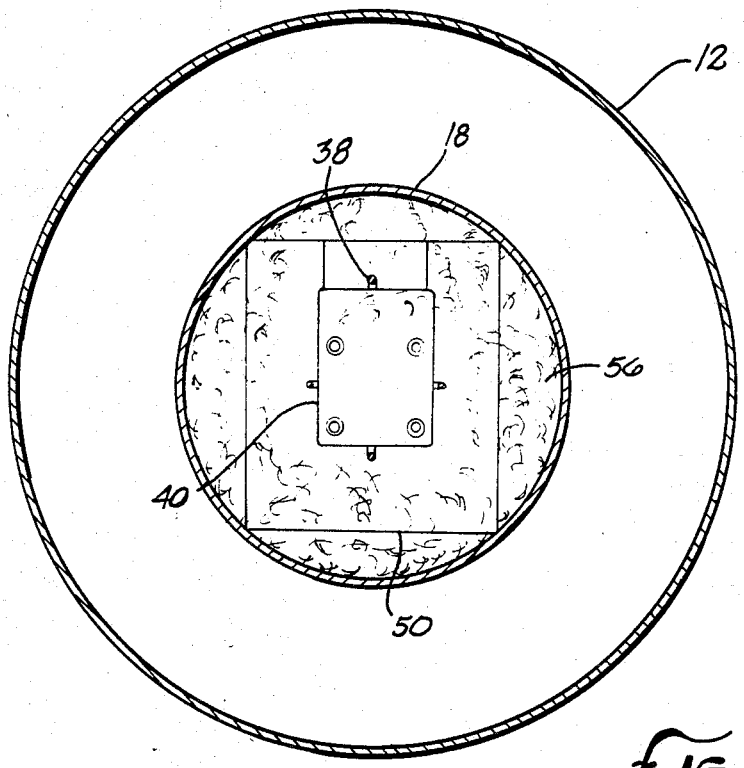
FIG. 3 is a cross-sectional view taken along line 3—3 of FIG. 2.

Looking in greater detail to the first embodiment as illustrated in FIGS. 2 and 3, the same reference numbers are applied to identical or equivalent equipment in each of the embodiments. In FIG. 2, conduit 30 is illustrated as extending to the light 10. The structure of the face ring 14 illustrates a form of attachment to the niche 12 by means of a hook 31 extending from the face ring 14 over a flange 32 on the niche housing 12. A fastener is then positioned through the face ring 14 into a threaded bracket 33 on the niche housing 12.

The embodiment of FIGS. 2 and 3 generally contemplate a 12-volt lamp 34. The 12-volt lamp 34 includes an integral reflector 36. The lamp 34 is held in position by retaining springs 38 of which there are four. Centered within the springs 38 is a socket 40. The socket 40 receives the lamp contact in a conventional manner.

Two leads 42 and 44 extend from the socket 40. The lead 42 is directly coupled to one wire of the conduit 30 by any conventional means such as a crimp connector 46. The second lead 44 is coupled with a second wire of the conduit 30 through a bimetal thermal switch (not shown) common to conventional enclosed lighting. A ground wire from the conduit 30 extends to an attachment point 48 and electrical contact with the housing 18. A junction box 50 surrounds the connections and supports the springs 38, socket 40 and 12-volt lamp 34. A potting compound 52 such as epoxy is poured in and about the junction box 50 and is allowed to set or cure to permanently waterproof the connections. A rubber grommet 54 provides some sealing but is not anticipated to provide the ultimate and complete seal. The grommet 54 along with a retaining hog ring 55 and the potting compound 52 provide sealing and such stress relief as may be needed.

Forwardly of the potting compound 52 so as to surround the 12-volt lamp 34 and integral reflector 36 is a body of copper wool 56 packed within the housing 18. The body of copper wool 56 forms heat-conductive elements between the lamp 34, particularly the reflector portion 36 thereof, and the inner wall of the housing 18. The housing 18 is also preferably of heat-conductive material such as deep drawn stainless steel. The water contained within the annular cavity about the light 10 then receives the heat conducted through the body of wool 56 for more efficient transfer. The cooper wool 56 is also electrically conductive and provides a path to ground from the reflector in the event of total electrical breakdown.

Forwardly of the 12-volt lamp 34 is the lens 16. The lens may be clear, colored, or optically directional or diffusing. The lens 16 is positioned within a U-shaped silicon gasket 58. The gasket 58 is in turn positioned within an annular clamp 60 which may be tightened at bracket 62 in the manner of a conventional clamp band. Also positioned within the clamp 60 is a flange 64 on the face ring 14. In this way, the face ring 14 and the light 10 are rigidly fixed together.

Figure 4:
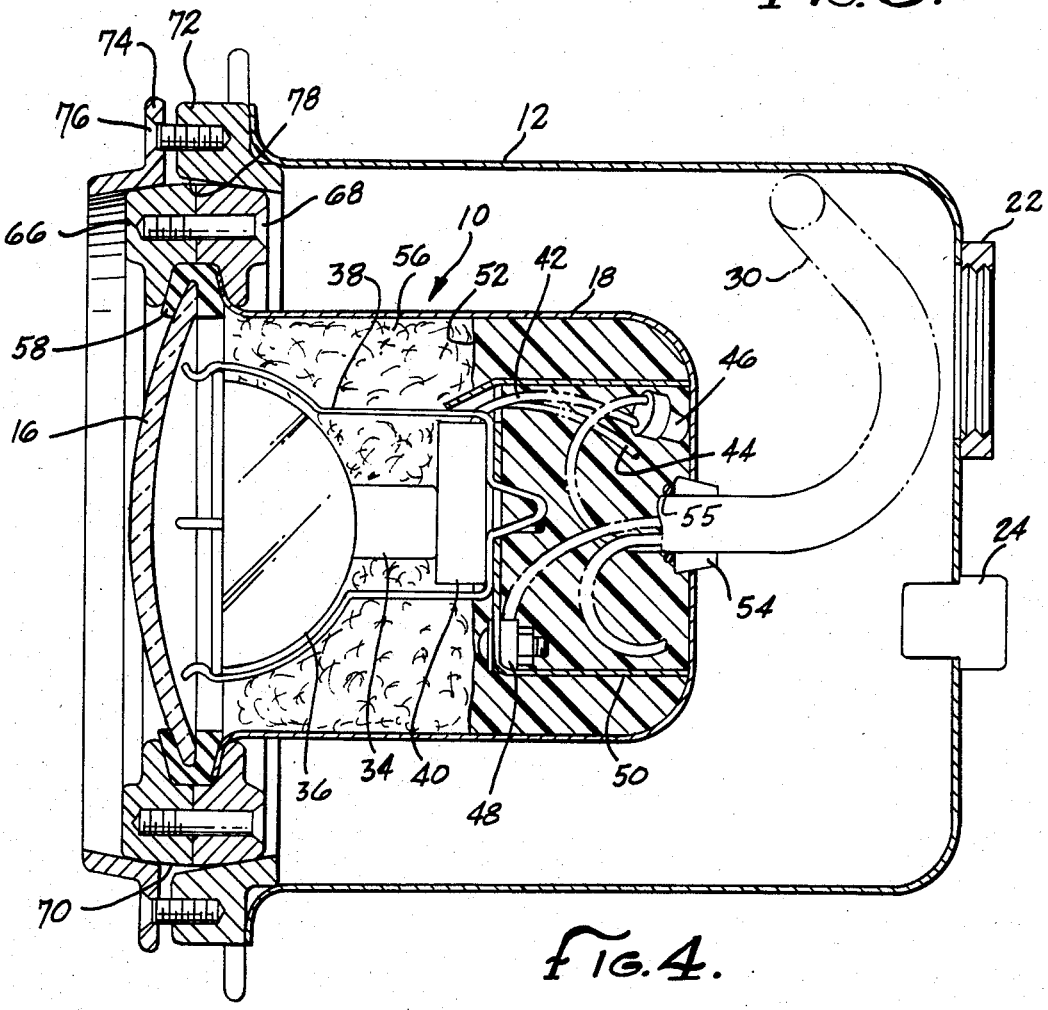
FIG. 4 is a cross-sectional side view of a second embodiment of the present invention.

Looking to the embodiment of FIG. 4, the light 10 is generally identical to that of the embodiment of FIGS. 2 and 3. However, replacing the annular clamp 60 is a two-part annular ring 66 held together by fasteners 68. The ring 66 defines a channel or groove for receipt of the gasket 58 and lens 16. On the outer surface of the ring 66 is an outwardly convex annular surface 70 which is defined as a surface of revolution and may in fact be a portion of a sphere. The ring 66 is fixed to the light 10 such that the assembly moves integrally. Outwardly of the ring 66 is a portion of the niche housing 12 defining an annular boss 72. A cover plate 74 is fixed to the boss 72 by means of fasteners 76. The annular boss 72 and the cover plate 74 define as part of the niche housing an inwardly concave surface of revolution 78 to mate with the outwardly convex surface of revolution 70 of the ring 66 of the overall lens assembly of the light 10. The tension in the fastener 76 determines the fit between the ring 66 and the niche housing. Consequently, the light 10 may be externally directed up to approximately 18° in the preferred embodiment from a line normal to the pool surface in which the niche housing 12 is positioned. It remains that holes are to be provided either through the ring 66 or the boss 72 such that water may flow inwardly to surround the light housing 18. Again, the embodiment of FIG. 4 illustrates a 12-volt lamp 34 with integral reflector assembly 36 which may advantageously be a quartz halogen lamp.

Figure 5:
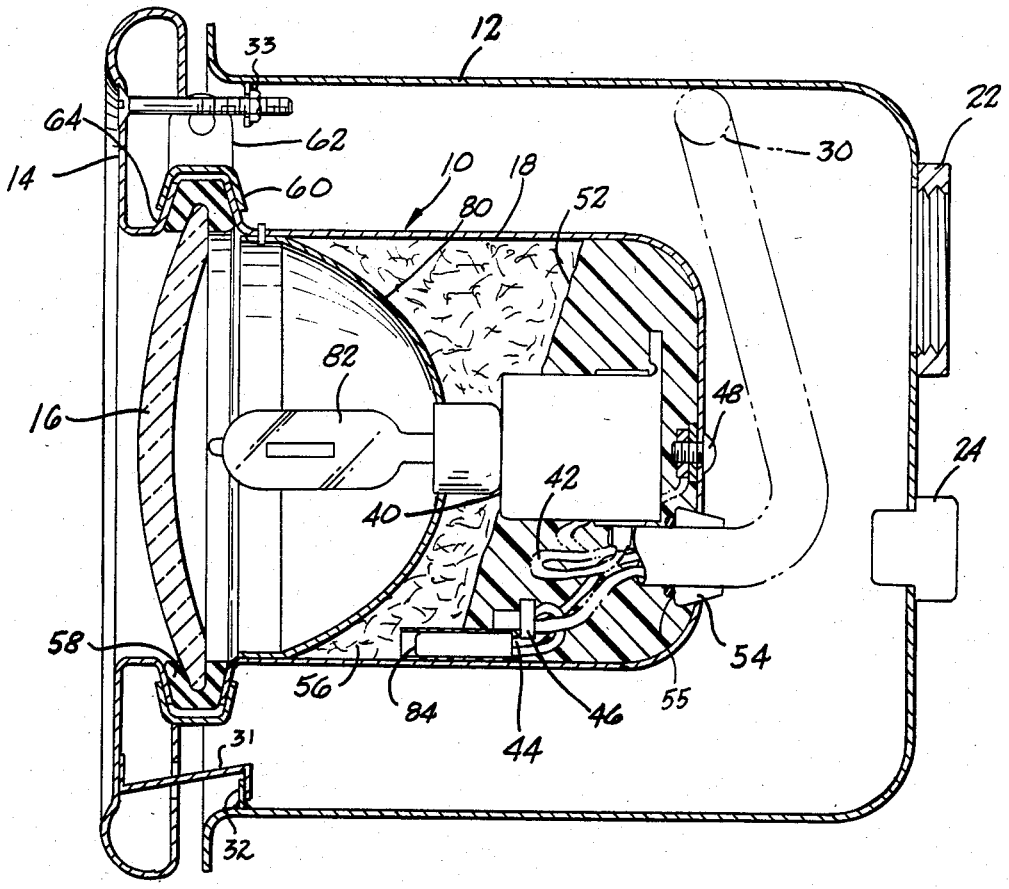
FIG. 5 is a cross-sectional side view of a third embodiment of the present invention.

Looking next to the embodiment of FIG. 5, a light 10 is illustrated which includes a separate reflector 80 and a 120-volt lamp 82. The lamp 82 is also conveniently of the quartz halogen type and may be optionally 100, 150 or 250 watts. The separate reflector 80 is dish-shaped and extends outwardly from a central position around the lamp 82 and forwardly to the inner side of the housing 18. A bimetal thermal switch 84 is illustrated and the potting compound 52 is fixed or cured at an angle to better extend the switch 84 forward. With the arrangement of FIG. 5, heat may be transferred through the reflector 80 directly to the housing 18 or through the copper wool 56 to the housing 18. In either event, water surrounding the housing 18 directs heat from the light.

Accordingly, an improved underwater light is disclosed as including high heat transfer efficiency. Both 12-volt and 120-volt arrangements are illustrated and a directional positioning feature is included. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An underwater light, comprising a thermally-conductive housing having a first opening;

a lens assembly sealably closing said first opening;

a heat conductive reflector within said housing directed toward said opening;

a lamp within said reflector; and thermally-conductive elements comprising metallic wool material extending between said reflector and said housing and in thermal contact therewith.

2. The underwater light of claim 1 wherein said reflector is integral with said lamp.

3. The underwater light of claim 1 wherein said lamp is separably positioned within said reflector.

4. The underwater light of claim 1 wherein said lamp is a quartz halogen lamp.

5. The underwater light of claim 1 wherein said reflector is grounded to said housing through said wool material.

6. The underwater light of claim 1 wherein said lens is around about 20 square inches in surface area.

7. The underwater light of claim 1 wherein said elements are copper wool.

8. The underwater light of claim 1 wherein said reflector is dish-shaped and extends from about said lamp outwardly to said housing and forwardly toward said first opening.

9. The underwater light of claim 1 further comprising a socket having electrical leads and a potting compound within said housing, said leads being located within said potting compound, said potting compound being most distant in said housing from said opening, said reflector being proximate in said housing to said opening and said thermally-conductive elements being between said reflector and said potting compound.

10. The underwater light of claim 1 further comprising a socket having electrical leads and a potting compound within said housing, said leads being located within said potting compound.

11. The underwater light of claim 10 wherein said potting compound is most distant in said housing from said opening, said reflector is proximate to said opening and said metallic wool is between said reflector and said potting compound.

12. The underwater light of claim 1 further comprising a niche housing about said housing and spaced therefrom, said space between said niche housing and said housing being in communication with the environments ahead of said lens.

13. The underwater light of claim 12 wherein said lens assembly includes a lens and a circular clamp annularly disposed about said lens, said circular clamp having an outwardly convex surface of revolution, said niche having an inwardly concave surface of revolution, said outwardly convex surface mating with said inwardly concave surface such that said lens assembly may be pivoted about axes perpendicular to the axis of revolution of said inwardly concave surface of revolution.

14. The underwater light of claim 13 wherein said housing, said clamp and said lens are rigidly fixed together to pivot about said axes perpendicular to the axis of revolution of said inwardly concave surface of revolution.

* * * * *